US009950859B2

(12) United States Patent
Steinkamp et al.

(10) Patent No.: US 9,950,859 B2
(45) Date of Patent: Apr. 24, 2018

(54) CIGARETTE PACK WITH SEALING BLOCK

(71) Applicant: Focke & Co. (GmbH & Co. KG), Verden (DE)

(72) Inventors: Irmin Steinkamp, Hemslingen (DE); Andreas Lübeck, Oyten (DE); Thomas Losereit, Worpswede (DE)

(73) Assignee: Focke & Co. (GmbH & Co. KG), Verden (DE)

( * ) Notice: Subject to any disclaimer, the term of this patent is extended or adjusted under 35 U.S.C. 154(b) by 0 days.

(21) Appl. No.: 15/133,557

(22) Filed: Apr. 20, 2016

(65) Prior Publication Data

US 2016/0229620 A1 Aug. 11, 2016

Related U.S. Application Data

(63) Continuation-in-part of application No. PCT/EP2014/002340, filed on Aug. 27, 2014.

(30) Foreign Application Priority Data

Nov. 4, 2013 (DE) ..... 10 2013 018 429

(51) Int. Cl.
*B65D 85/10* (2006.01)
*A24F 15/00* (2006.01)
*B65D 77/30* (2006.01)

(52) U.S. Cl.
CPC ..... *B65D 85/1045* (2013.01); *A24F 15/00* (2013.01); *B65D 77/30* (2013.01); *B65D 2575/586* (2013.01)

(58) Field of Classification Search
CPC A24F 15/00; A24F 15/12; B65D 5/54; B65D 77/30; B65D 85/10; B65D 85/1045; B65D 2575/586
USPC ..... 206/264, 268, 271–275
See application file for complete search history.

(56) References Cited

U.S. PATENT DOCUMENTS 3,948,389 A 4/1976 Molins
5,137,148 A 8/1992 Evers
5,480,025 A 1/1996 Draucker
8,123,030 B2 * 2/2012 Hein ..... B65B 19/20 206/273

(Continued)

FOREIGN PATENT DOCUMENTS

CN 2296328 Y 11/1998
CN 1207357 A 2/1999

(Continued)

OTHER PUBLICATIONS

Deutsches Patent—Und Markenamt (German Patent and Trademark Office), Recherchenbericht (search on related application), Jun. 18, 2014.

(Continued)

*Primary Examiner* — Bryon Gehman
(74) *Attorney, Agent, or Firm* — Laurence P. Colton; Smith Tempel Blaha LLC

(57) ABSTRACT

A sealing block for a cigarette group (12) is provided on the inside with an internal collar (42). The latter is composed of an internal front wall (45), an internal base wall (48), and internal side flaps (46). The internal base wall (48) is configured in a reinforcing manner by folding flaps disposed on top of one another, specifically by the base tab and the base flap.

7 Claims, 8 Drawing Sheets

(56) References Cited

U.S. PATENT DOCUMENTS

| | | | | |
|---|---|---|---|---|
| 9,533,821 | B2 * | 1/2017 | Buse | B65B 19/025 |
| 9,788,575 | B2 * | 10/2017 | Buse | B65D 85/1045 |
| 2003/0164314 | A1 | 9/2003 | Bray | |
| 2012/0292208 | A1 | 11/2012 | Draghetti | |

FOREIGN PATENT DOCUMENTS

| | | | |
|---|---|---|---|
| CN | 2378346 | Y | 5/2000 |
| DE | 102007009251 | A1 | 8/2008 |
| DE | 102010019867 | A1 | 9/2011 |
| DE | 102011119344 | A1 | 4/2013 |
| GB | 789627 | A | 1/1958 |
| WO | 2009098297 | A1 | 8/2009 |
| WO | 2013053408 | A1 | 4/2013 |
| WO | 2014013478 | A1 | 1/2014 |

OTHER PUBLICATIONS

WIPO, International Search Report (on parent application), dated Mar. 4, 2015.

State Intellectual Property Office of the People's Republic of China, Notification of the First Office Action (in related application), dated Nov. 28, 2016.

* cited by examiner

CIGARETTE PACK WITH SEALING BLOCK

STATEMENT OF RELATED APPLICATIONS

This application is a continuation-in-part of International Patent Application No. PCT/EP2014/002340 having an international filing date of 27 Aug. 2014, which claims priority on and the benefit of German Patent Application No. 10 2013 018 429.0 having a filing date of 4 Nov. 2013.

BACKGROUND OF THE INVENTION

Technical Field

The invention relates to a pack for cigarettes, in which a cigarette group is surrounded by a blank of foil while a sealing block is formed, wherein a supportive element of thin cardboard or of a comparable material—an internal collar—which has an internal front wall, an internal base wall, and internal side flaps and which at least partially surrounds the cigarette group is disposed in the interior of the sealing block, or a pack, in particular for cigarettes, in which a cigarette group is surrounded by a blank of foil while a sealing block is formed, wherein a supportive element of thin cardboard or of a comparable material—an internal collar—which has an internal front wall, an internal base wall, and internal side flaps and which at least partially surrounds the cigarette group is disposed in the interior of the sealing block.

Prior Art

Sealing packs for cigarettes are usually configured such that a supportive element or an internal collar, which causes increased dimensional stability of the sealing block and protects the cigarettes from mechanical and thermal stress, is disposed within a sealing block which has a tight foil envelope. The cigarette block which is closed on all sides finds a receptacle in an external pack which is preferably configured as a hard-pack hinge-lid box.

German Patent Application No. DE 10 2011 119 344 A1 shows and describes a sealing pack of this type for cigarettes, having an approximately tray-shaped internal collar which has an internal front wall extending across substantially the full height of the cigarettes, an internal base wall, and internal side walls extending on the narrow sides of the cigarette block. The rear side of the cigarette group in this embodiment of the internal collar is free.

BRIEF SUMMARY OF THE INVENTION

The invention is based on the object of configuring a cigarette pack of the embodiment mentioned at the outset in terms of the internal supportive element or of the internal collar, respectively, such that better protection and in particular a more stable structure of the internal collar is provided.

In order for this object to be achieved, the pack according to the invention is configured as a pack, in particular for cigarettes, in which a cigarette group is surrounded by a blank of foil while a sealing block is formed, wherein a supportive element of thin cardboard or of a comparable material—an internal collar—which has an internal front wall, an internal base wall, and internal side flaps and which at least partially surrounds the cigarette group is disposed in the interior of the sealing block, characterized in that the internal supportive element or the internal collar, respectively, in a lower region that faces the internal base wall is configured so as to have a closed cross section, that is to say so as to be annular, in such a manner that the cigarette group in this region is on all sides surrounded by the supportive element or the internal collar.

Also in order for this object to be achieved, the pack according to the invention is configured as a pack, in particular for cigarettes, in which a cigarette group is surrounded by a blank of foil while a sealing block is formed, wherein a supportive element of thin cardboard or of a comparable material—an internal collar—which has an internal front wall, an internal base wall, and internal side flaps and which at least partially surrounds the cigarette group is disposed in the interior of the sealing block, characterized in that the internal base wall is formed from a base flap or has a base flap, respectively, which on account of a corresponding punching line is configured as a part-face of the internal front wall and by folding, in particular by successive folding steps, is folded into the plane of the internal base wall.

Increased or sufficient dimensional stability of the internal collar having the cigarette group enveloped therein, is thus achieved when the internal collar at least in a lower, base-side region has a closed structure. Moreover, the cigarette group is stabilized in the formation by the configuration of the internal collar according to the pack, such that production of the cigarette block or of the sealing block, respectively, is facilitated and the sealing block moreover forms a unit which overall is dimensionally stable. Side flaps, which are connected to the internal front wall and to the internal rear wall extending across a part-height, in the case of at least partial superimposition are mutually interconnected in a permanent manner (for example by adhesive bonding).

The internal front wall expediently extends across the full height, while the internal rear wall covers only a part-height, approximately up to half the height of the cigarette group. The internal collar is preferably provided with internal side walls which are composed of at least partially mutually superimposing internal side flaps of the front wall, on the one hand, and of the rear wall, on the other hand.

According to one alternative, increased dimensional stability of the internal collar is achieved in that the base wall of the internal collar has reinforcements formed by folding flaps which are composed of folding flaps formed by corresponding punched features in the region of the internal front wall and are folded by successive folds into the plane of the internal base wall. The folding flaps of the base wall are preferably secured by plug-in connections.

A particularity lies in the attachment of a punched feature or a clearance or a gap, respectively, in the side wall, in particular in the internal side flaps which extend across the full height of the cigarettes. This punched feature is preferably provided in the case of a sealing block having a transverse seam at the rear and so as to be level with this transverse seam, wherein end pieces of the transverse seam—in the region of side walls—lie within the gap or the punched feature, respectively.

The blanks for the internal collar are severed from a stripe-shaped material web by transversely-directed punched cuts. Tongue-type protrusions which are created thereby may be removed by being folded back into the plane of the internal base wall or be severed as waste.

Preferably, the design of the external pack in the embodiment as a hinge-lid box having a standard (external) collar is adapted to the construction of the internal collar (having a cigarette group). The collar of the hinge-lid box (external collar) is dimensioned such that a lower delimitation or a lower peripheral edge, respectively, at least of lateral flaps of the collar (in the box part) ends above, preferably at a minor spacing from the free upper edge of the internal rear wall of the internal collar. On account thereof, an accumulation of a plurality of layers of the internal collar, on the one hand, and of the external pack, on the other, is avoided.

BRIEF DESCRIPTION OF THE DRAWINGS

Further details and features of the packs according to the invention will be discussed in more detail hereunder by means of the patent drawings in which.

DETAILED DESCRIPTION OF PREFERRED EMBODIMENTS

Sealing packs for cigarettes 10 are usually configured such that a (flavor-tight and moisture-tight) foil envelops the cigarettes 10 or a cigarette group 12 of formatted cigarettes 10, respectively, on all sides, while forming a sealing block 11. Folding flaps are interconnected by adhesive bonding or thermal sealing, while maintaining the seal structure.

Figure 2:
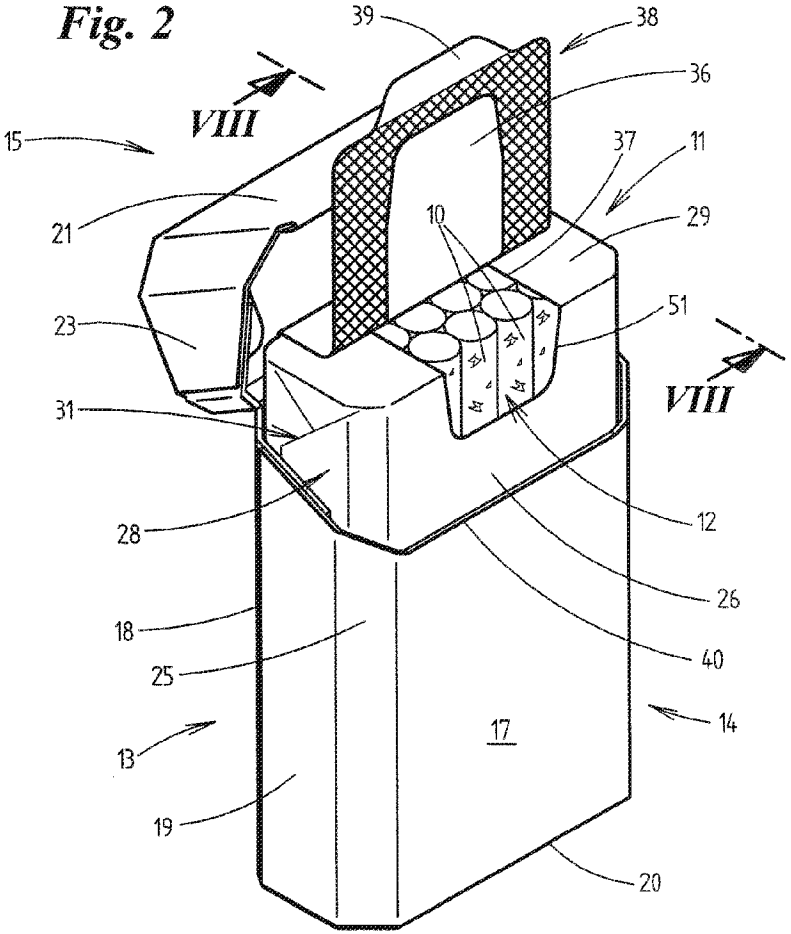
FIG. 2 shows the pack according to FIG. 1, with the sealing block opened, likewise in a perspective view.
Figure 1:
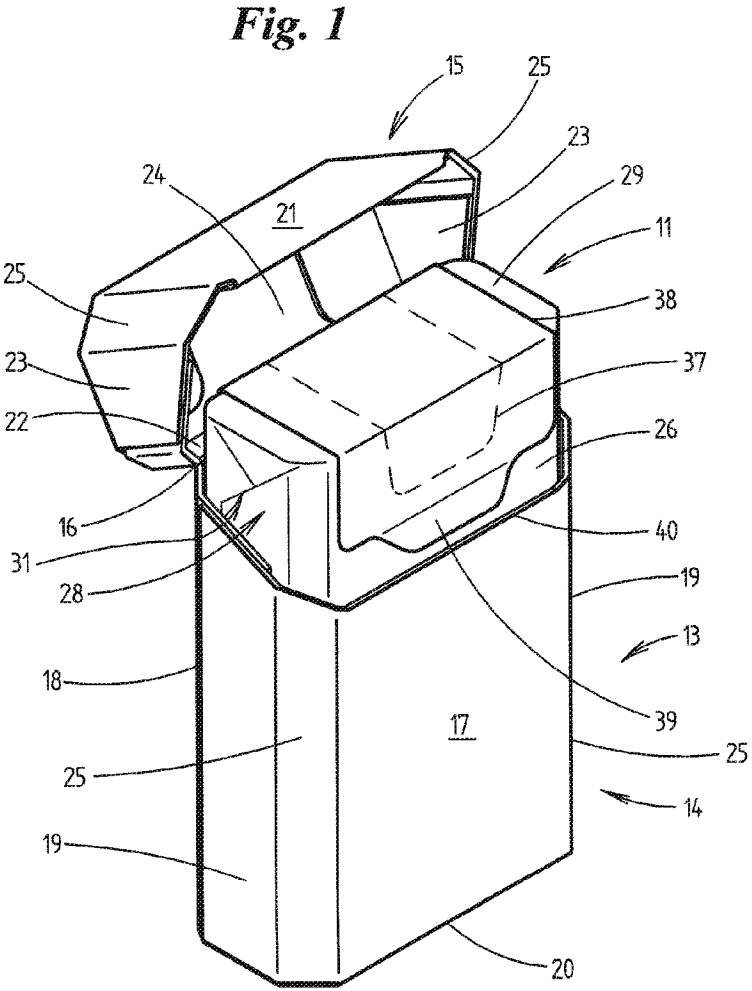
FIG. 1 shows a cigarette pack having a sealing block in a hinge-lid box as an external pack, with the lid opened, in a perspective view.
Figure 3:
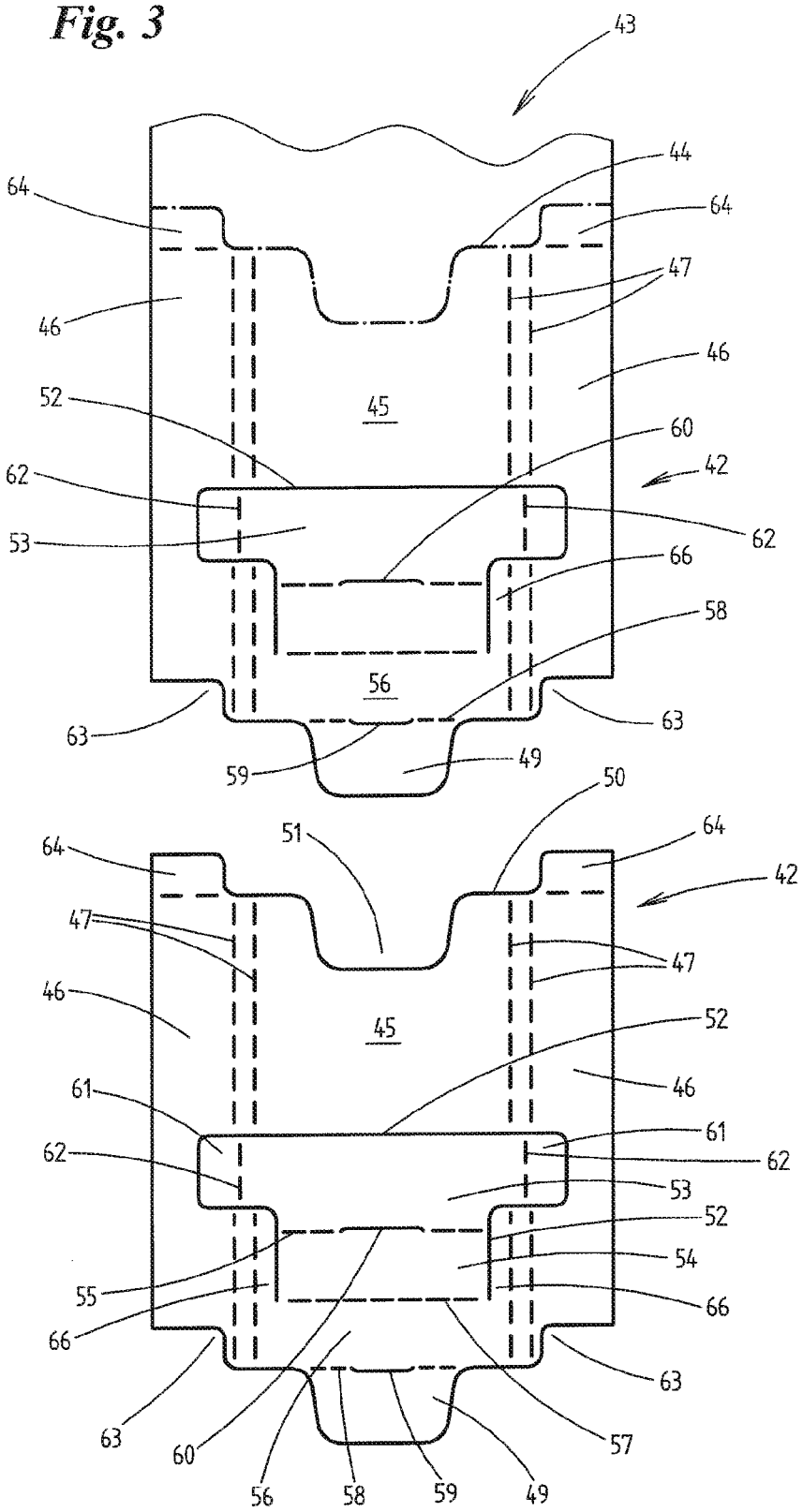
FIG. 3 shows a portion of a material web having a blank for an internal collar.

The sealing block 11 is expediently disposed in an external pack 13 which is configured as a hard pack, presently in the embodiment as a hinge-lid pack. This widely used type of pack is composed of a (lower) box part 14 and of a lid 15. The latter is pivotably connected to the box part 14 by way of a linear articulation 16 on the rear side. The opened position of the lid 15 is shown in FIGS. 1 and 2.

Figure 8:
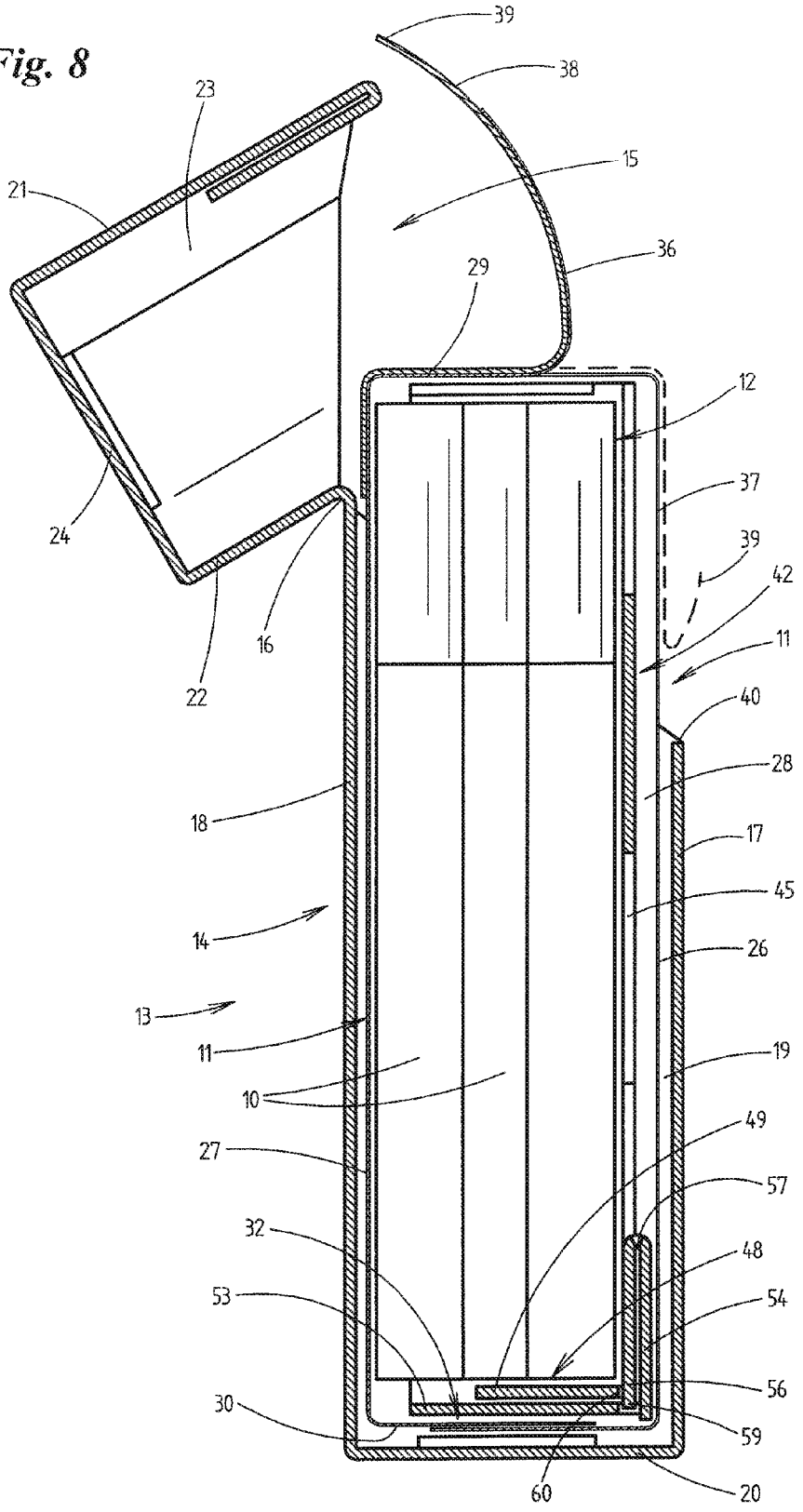
FIG. 8 shows a complete (cigarette-) in the embodiment and position according to FIG. 2, in a vertical sectional plane VIII-VIII and in an enlarged scale.

The box part in the usual manner is composed of a box front wall 17, an opposite box rear wall 18, box side walls 19, and a base wall 20. Accordingly, the lid 15 has a lid front wall 21, a lid rear wall 22, lid side walls 23, and an end wall 24. The external pack 13 shown in FIGS. 1 and 2 is configured as an octagonal pack having upright oblique edges 25. A further peculiarity in the exemplary embodiment according to FIGS. 1, 2 and 8 lies in that the hinge-lid pack does not have a usual collar which extends in the region of the box front wall 17 and the box side flaps 19 and protrudes from the box part 14. Instead, the lid 15 in the closed position directly surrounds the sealing block 11 which is configured with corresponding rigidity.

The sealing block 11 or the foil enveloping the cigarette group 12, respectively, is thermally sealable. The rectangular blank is folded such that partially mutually superimposing folding flaps are mutually interconnected while forming sealed seams. The sealing block 11 is substantially ashlar-shaped, having a block front wall 26, a block rear wall 27, block side walls 28, a block end wall 29, and a block base wall 30. In the exemplary embodiment according to FIGS. 1 to 8, lateral seams 31 in the region of substantially trapezoidal and mutually partially superimposing folding flaps (so-called envelope fold) are formed in the region of the upright block side walls 28. The block end wall 29 is free of folds. A base seam 32 is presently likewise configured as an envelope fold.

Alternatively (FIG. 11), the sealing block 11 may have fin folds, specifically the lateral seams 31 and one transverse seam 33. The lateral seams 31 in the region of the block side walls 28 is composed of two material strips or flaps, respectively, which are interconnected in a transverse fold position and are folded back as a unit against the block side wall 28 (FIGS. 11, 12).

The block end wall 29 and the block base wall 30 are free of folds. Instead, a transversely directed fin seam, specifically the transverse seam 33, is disposed in the region of the block rear wall 27, having significant spacing from the block base wall 30, preferably approximately at half the height. The transverse seam 22 by way of end pieces 34 and on account of corresponding folding extends into the region of the block side walls 28. The arrangement has been arrived at such that the transverse seam 33 is initially manufactured, then the lateral folds are carried out, such that the fin of the lateral seam 31 is folded against or onto the end piece 34 of the transverse seam 33, respectively, and thus covers the end piece 34 (FIGS. 11 and 12).

The sealing block 11 is provided with an opening aid which is substantially known. The latter extends in the region of the block end wall 29, in an adjacent region of the block front wall 26, and optionally by way of a part-region in the block rear wall 27. A closure tab 36 which in the opened position (FIG. 2) exposes a corresponding removal opening 37 for the cigarettes 10 is delimited by way of a cross-sectional attenuation of the foil—perforation line 35. The closure tab 36, and thus the removal opening 37, is completely covered by a closure label 38 which presently is composed of a dedicated blank and by means of a (permanent) adhesive that is applied on the entire area bears in an adhesive manner on the external side of the closure tab 36 and—in the closed position—on part-areas of the sealing block 11, specifically on peripheral regions of the removal opening 37. For (multiple) opening of the sealing block 11, the closure label 38 may be acquired and actuated by means of a glue-free gripping tab 39 on a lower free periphery of the closure label 38. In the closed position (FIG. 1), a front-side leg of the closure label 38 having the gripping tab 39 is completely located in the region of the lid 15 (lid front wall 21), that is to say above a closure edge 40 of the box front wall 17.

Figure 11:
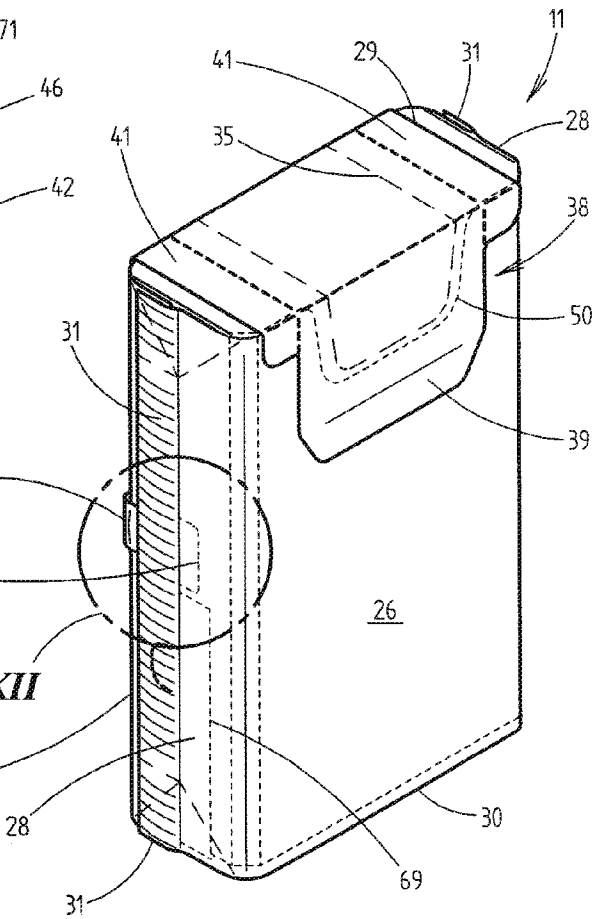
FIG. 11 shows a sealing block having contents corresponding to FIG. 10.
Figure 12:
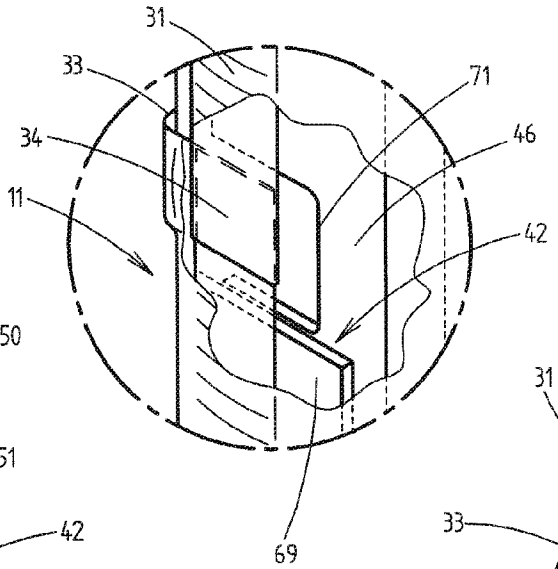
FIG. 12 shows a detail XII of the sealing block according to FIG. 11, in an enlarged scale.

In the embodiment according to FIG. 11, the sealing block 11 is provided with an opening mechanism of analogous configuration, wherein the closure label 38 however is provided with lateral stripe-shaped appendages 41 and in this manner extends (approximately) across the full width of the block end wall 29.

A supportive or protective element, respectively, positioned within the sealing block 11 and partly surrounding the cigarette group 12 is in the foreground. This element which is preferably composed of an integral blank of (thin) cardboard will henceforth be referred to as the internal collar 42. The internal collar 42 which is known in principle is presently configured such that increased dimensional stability and resistance in particular in relation to mechanical influences is provided in the lower region of the cigarette group.

In a first exemplary embodiment according to FIGS. 1 to 8, the internal collar 42 is composed of a blank (FIG. 3) which is severed from a continuous material web 43 by a transversely directed and contoured punching line 44. An internal front wall 45 is delimited from internal side flaps 46 by longitudinal folding lines 47. In the case of the exemplary embodiment shown, the blank of the internal collar 42 is oriented toward packs having oblique edges 25 ("octagonal packs"). Therefore, two parallel longitudinal folding lines 47 are provided.

An internal base wall 48 is configured in a particular manner, specifically in a multi-layered manner on account of mutually partially superimposed folding flaps. Further, an adjoining and upright region of the internal front wall 45 is likewise configured in a multi-layer or two-layered manner, respectively, on account of which overall increased dimensional stability of the internal collar 42 is achieved in a region facing the internal base wall 48.

Part of the internal base wall 48, or a layer thereof, respectively, is formed from an appendage or from a tongue-shaped base tab 49. This tab 49 of the blank for the internal collar 42, which is configured with rounded contours, is created by the contoured punching line 44. Opposite thereof, specifically in the region of a top edge 50 of the internal collar 42, a (centric) depression or clearance 51, respectively, which facilitates the removal of cigarettes 10 when the removal opening 37 of the sealing block 11 is exposed, is provided. On account of corresponding folding steps, the base tab 49 is positioned on the upper side of the internal base wall 48, and thus forms an internal layer having partial coverage of the base area.

Further layers or folding flaps, respectively, of the internal base wall 48 are formed from part-regions of the internal front wall 45. The latter, in a lower region, is provided with a punching line 52 which is preferably attached in the region of the material web 43 or simultaneously with severing the internal collar 42, respectively. The punching line 52 is positioned and designed such that a further base flap 53, which on account of targeted folding steps is folded into the plane of the internal base wall 48, presently against the free lower side of the base tab 49, is created. The punching line 52 is dimensioned such that a transversely directed connection flap 54 is achieved as part of the internal front wall 45, in addition to the base flap 53.

Figures 4, 5, 6, 7:
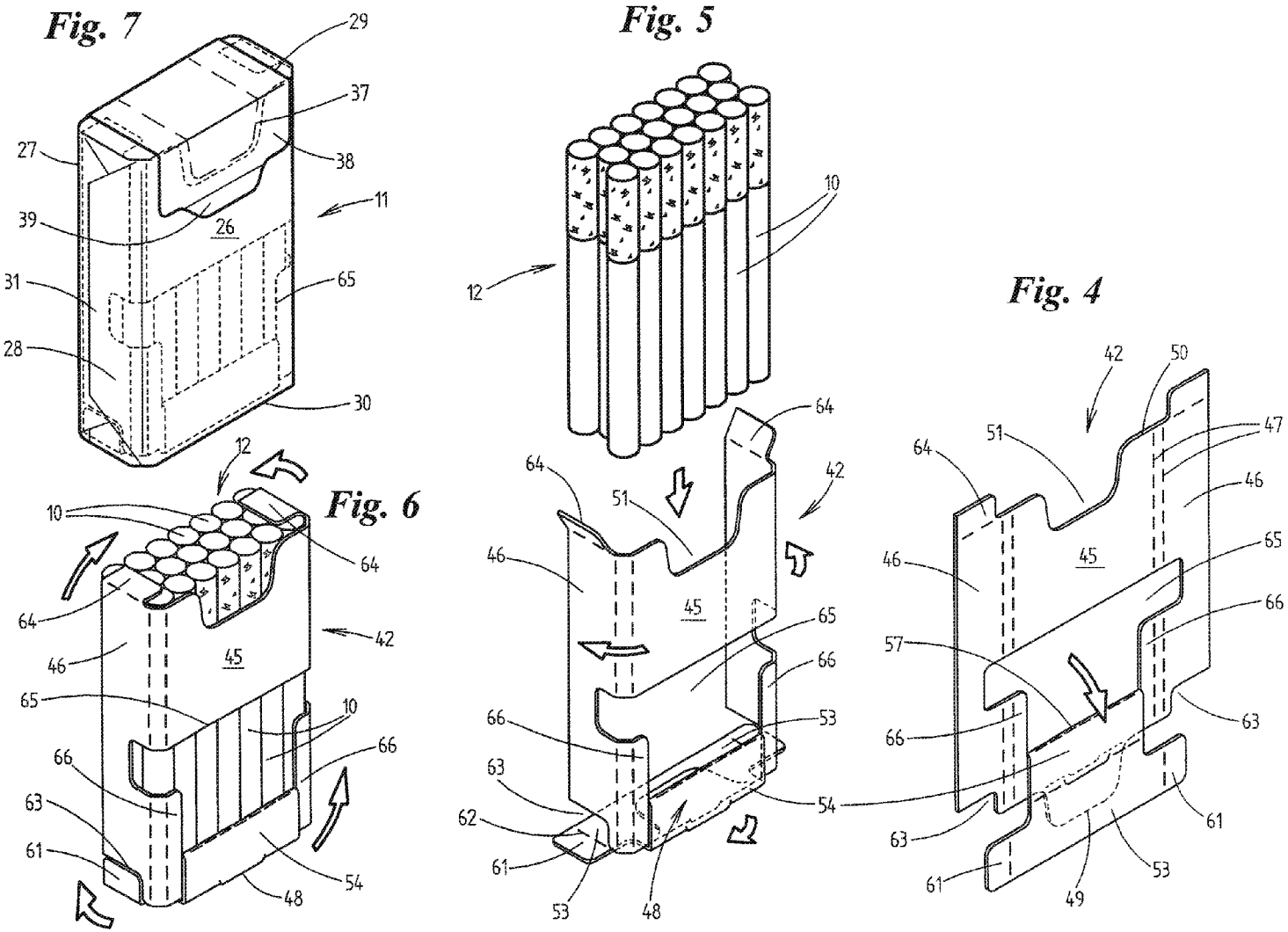
FIG. 4 shows the internal collar after a first folding step.
FIG. 5 shows the internal collar after further folding steps during the introduction of a cigarette group, in a perspective view.
FIG. 6 shows a cigarette group having a completely folded internal collar, in a perspective view.
FIG. 7 shows a sealing block having contents corresponding to FIG. 6.

The base flap 53 and the connection flap 54 are mutually delimited by a transversely directed folding line 55. Furthermore, the connection flap 54 in relation to a base-side peripheral piece 56 of the internal front wall 45 is delimited by a further folding line 57. In a first folding step (FIG. 4) the unit of the base flap 53 and of the connection flap 54 is folded into a downwardly directed intermediate folded position while partially bearing (externally) on the peripheral piece 56 (FIG. 4). The dimensions and spacings are selected such that the further folding line 55 is located approximately level with the plane of the internal base wall 48 to be manufactured. In a further folding step (about) 90°, the base flap 53 is now folded into the plane of the internal base wall 48, while bearing on the previously folded base tab 49.

The folding flaps of the internal base wall 48 may be interconnected with glue. A glue-free connection by way of mutually engaging plug-in tabs is presently achieved. On account of corresponding punched features, a plug-in tongue 59 is achieved in the region of a folding line 58 for delimiting the base tab 49. Said plug-in tongue 59, in the case of the folding tongues described, is introduced in an upright position (FIG. 8) into a plug-in slot 60 which is disposed in the region of the folding line 55 and has a greater length than the edge of the plug-in tongue 59.

The (external) base flap 53 of the internal base wall 48 is configured in a particular manner, specifically having lateral, flap-type appendage pieces 61 which are delimited in relation to the remaining part of the base flap by a folding line 62 running in a region between the longitudinal folding lines 47. After the base flap 53 has been folded, the appendage pieces 61 are uprighted into the plane of the internal base wall 48 (FIG. 5), that is to say folded into an upright position, such that said appendage pieces 61 preferably extend in the plane of the internal side flaps 46. The latter in the present exemplary embodiment are provided on the base side with a corner clearance 63 in which the appendage pieces 61 find a matching receptacle (FIGS. 6 and 7), such that these appendage pieces 61 extend in the plane of the internal side flaps 46.

The corner clearances 63 are created by the correspondingly contoured punching line 44. The latter in the region of the subsequent blank generates corresponding protrusions or end flaps 64, respectively, in the region of the internal side flaps 46. The end flaps 64 during completion of the unit of the cigarette group 12 and of the internal collar 42 are folded inward, while bearing on the end faces of cigarettes (in the region of filters of the latter).

The punching line 52 for the folding flaps assigned to the internal base wall 48 leads to a substantially T-shaped clearance 65 in the region of the internal front wall 45 and the internal side flaps 46. The profile of the punching line 52 is selected such that in a region facing the internal base wall 48, specifically corresponding substantially to the connection flap 54, peripheral webs 66 for stabilizing the (folded) internal collar 42 remain standing in the region of the internal front wall 45.

The folding sequence to be seen from FIGS. 4 to 6 is adhered to in the manufacture of the sealing block. The appendage pieces 61 are located in the plane of the internal base wall 48 in the position according to FIG. 5. The end flaps 64 are moved to an intermediate folded position, specifically are directed outward in a funnel-shaped manner. In this position, the formatted cigarette group 12 is introduced from above into the largely folded internal collar 42. Thereafter, the final folding steps, specifically uprighting of the appendage pieces 61 and folding back the end flaps 64 into the plane of an upper end face are carried out. Thereafter, the foil blank which has been made or prepared elsewhere, respectively, is folded about the unit of the cigarette group 12 and of the internal collar 42, wherein the folding flaps are interconnected by thermal sealing. The sealing block 11 according to FIG. 7 is then introduced into the external pack, presently into a hinge-lid box.

Figure 9:
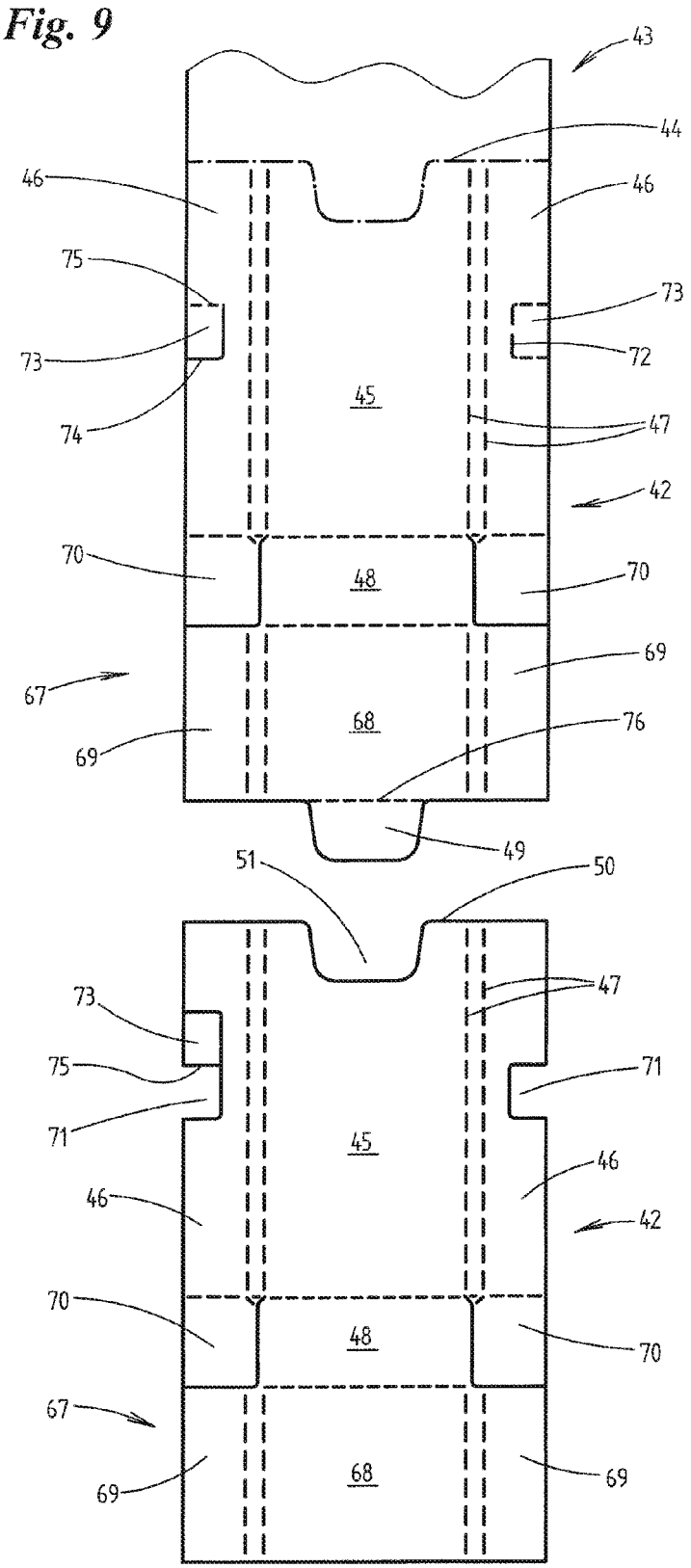
FIG. 9 shows an illustration analogous to that of FIG. 3, for another exemplary embodiment of a blank for an internal collar.
Figure 10:
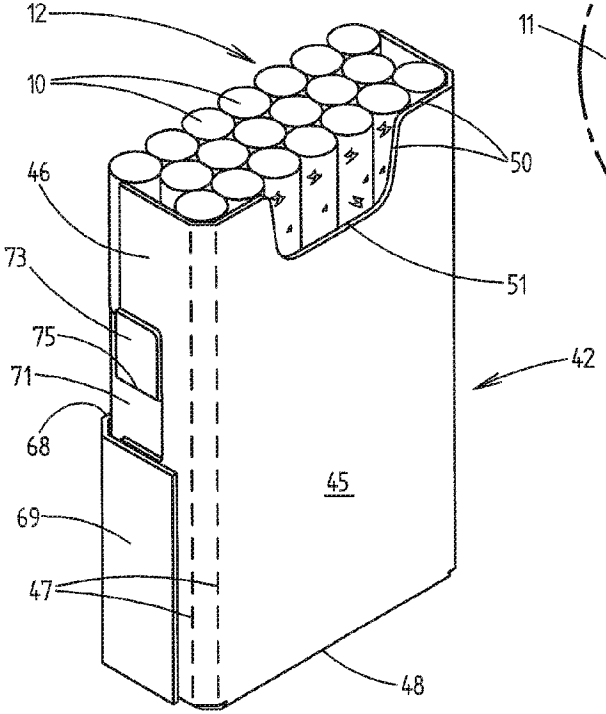
FIG. 10 shows a unit of a cigarette group and of a folded internal collar, in the embodiment according to FIG. 9, in a perspective illustration.

The exemplary embodiment according to FIGS. 9 to 11 relates to a sealing block 11 of which the internal collar 42 is configured in a particular manner and has increased dimensional stability. In particular, the internal collar 42 in this design and arrangement is suitable for holding comparatively large cigarette groups 12 composed of a plurality of rows in the formation (FIG. 10).

The blank for the internal collar 42 is likewise severed from a stripe-shaped material web 43 by a transversely directed punching line 44, according to FIG. 9. In an analogous manner to the preceding exemplary embodiment, an (upper) edge, specifically the top edge 50, having a clearance 51 for facilitating the removal of cigarettes 10 is achieved by means of the punching line 44.

The internal front wall 45 of the internal collar 42 extends substantially across the full height of the cigarettes 10 or of the cigarette group 12, respectively. As continuation of the internal front wall 45, a blank extension 67 which forms an internal rear wall 68—in continuation of the internal front wall 45 or of the internal base wall 48, respectively—and rear side flaps 69—corresponding to the internal side flaps 46—adjoins the internal base wall 48. In the present exemplary embodiment, base corner flaps 70, which according to FIG. 9 are connected to the internal side flaps 46 assigned to the internal front wall 45 and which in the case of the folded internal collar 42 bear on the internal base wall 48, are provided in the context of additional stabilizing of the base-side part of the internal collar 42.

The blank for the internal collar 42, thus configured, is folded about the cigarette group 12 in such a manner that a cup-shaped structure is achieved in a lower, base-side region. The internal rear wall 68 is uprighted and bears on the rear side of the cigarette group 12. The rear side flaps 69 of the internal rear wall 68 bear on the external side of the internal side flaps 46 and are preferably connected to the latter by glue or alternatively, in the case of a corresponding coating, by thermal sealing. The cigarette group 12 is therefore configured in a region having a closed cross section and facing the internal base wall 48, such that the cigarette group 12 is encompassed and held in an encircling manner.

The unit of the cigarette group 12 and of the internal collar 42, thus configured, is disposed in a sealing block 11 according to FIGS. 11 and 12, which in details deviates from the sealing block of FIG. 7 and is described hereabove.

The design of the packing unit or of the sealing block 11, respectively, is selected such that the internal rear wall 68 (including the rear side flaps 69) ends below the transverse seam 33. The transverse seam 33 therefore extends above the cup-shaped part of the internal collar 42, such that accumulations of material layers are avoided.

The internal collar 42 in the region of the internal side walls may be provided with a material clearance. In the exemplary embodiment according to FIGS. 10 to 12, the internal side flaps 46 are provided with a clearance 71 which is open toward the free periphery. Said clearance 71 is formed by a corresponding punched feature, preferably while severing the blank for the internal collar 42 from the material web 43. Two dissimilar solutions are shown: The punched feature 72 may be configured so as to be U-shaped, having residual connections. During further processing of the blank, in particular prior to folding, a corresponding material piece 73 is severed as waste and removed. On account thereof, a clearance 71 which is delimited by a U-shaped edge is created (right side in FIG. 9). Alternatively, the punched feature 72 may be configured such that an angular severing cut 74 is formed and the material piece 73 is folded about a folding line 75 against the internal side flap 46, preferably the external side (FIG. 9, left). The clearance 71 is preferably positioned such that the transverse seam 33, or the end pieces 34 thereof, lie (completely) in the region of the clearance 71 (FIG. 12). In the case of the alternative having the folded material piece 73, the latter lies outside the clearance 71.

Moreover, in the example shown the base tab 49 which is formed by the punching line 44 while manufacturing the blank is removed as waste, specifically on account of a corresponding attenuation line 76. The latter is attached during the manufacture of the blank. The tab 49 is severed from the blank by tearing in the further course of production.

Figure 13:
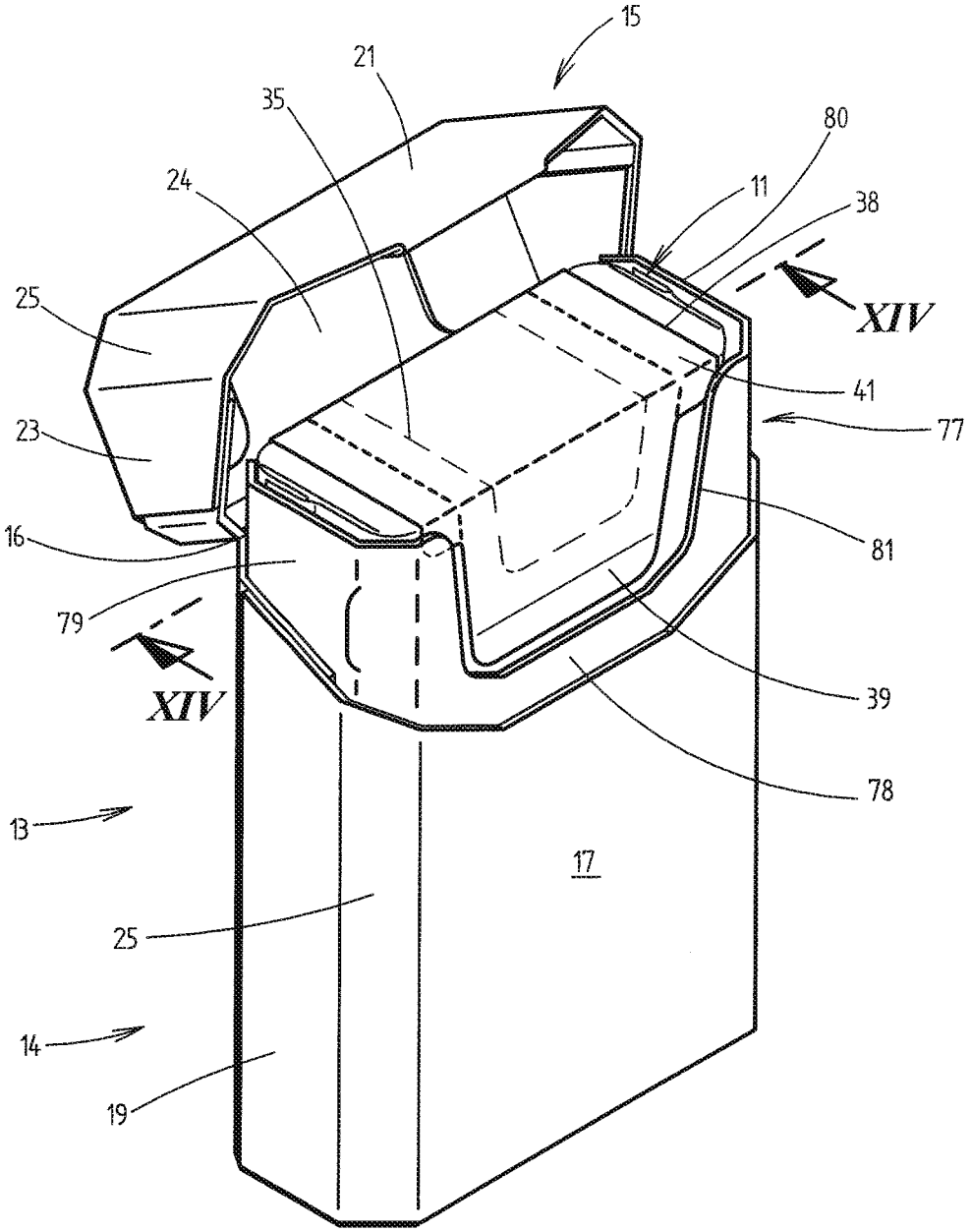
FIG. 13 shows an illustration in an analogous manner to FIG. 1, for a further exemplary embodiment of the entire pack in a perspective view.
Figure 14:
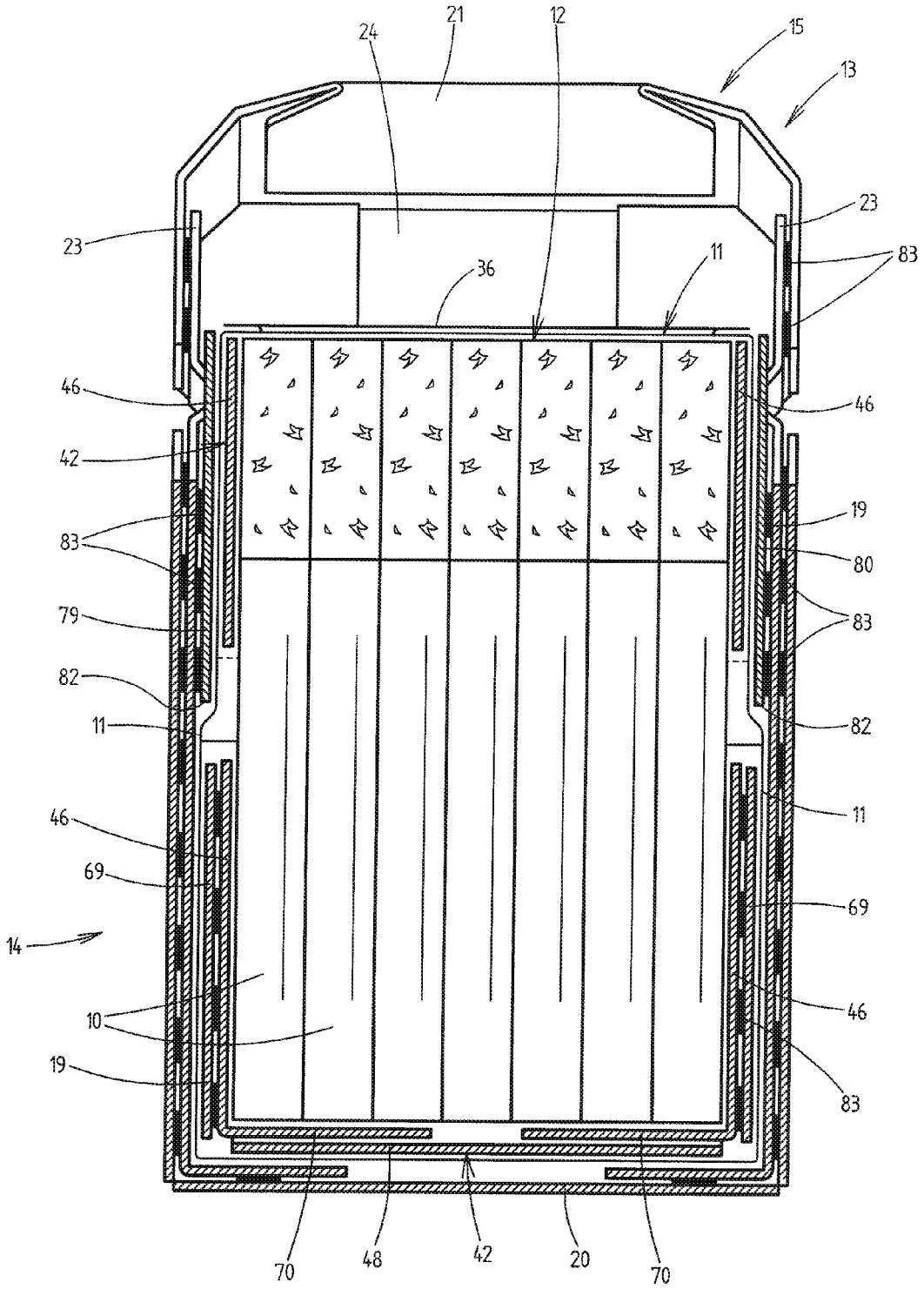
FIG. 14 shows the pack according to FIG. 13 in a central vertical section, specifically in the sectional plane XIV-XIV of FIG. 13, in an enlarged scale.

The sealing block 11 finds a receptacle in an external pack 13, preferably in the embodiment of a hinge-lid box. One particularly advantageous design of the entire pack results from FIGS. 13 and 14. The external pack 13 is a standard hinge-lid box, that is to say having a box part 14 and a lid 15. A collar or external collar 77, respectively, which is fundamentally known in the case of hinge-lid boxes, is disposed in the box part 14. Said collar or external collar 77, respectively, is composed of a collar front wall 78 and of collar side flaps 79, 80. The external collar 77 is disposed as usual in the box part 14 in such a manner that a lower part-region of the collar front wall 78 bears on the inside of the box front wall 17.

Furthermore, a clearance 81 which is usual in this type of pack and which is dimensioned and disposed such that the closure label 38 (leg of the closure label) including the gripping tab 39 lies completely in the region of the clearance 81 and may thus be operated is attached in the region of the collar front wall 78. The closure tab 38 is preferably configured in the form shown in FIG. 11.

A particularity lies in the tuning of the dimensions of the external collar 77 to the dimensions and the design of the internal collar 42 in the embodiment according to FIG. 10. The internal rear wall 68 and the rear side flaps 69 of the internal rear wall 68 are dimensioned and adapted to the dimensions of the external collar 77 such that the mentioned folding flaps 69, on the one hand, and 79, 80, on the other hand, are not mutually superimposed. Rather, a (significant) spacing exists between a lower edge 82 of the collar side flaps 79, 80, on the one hand, and the upper delimitation of the rear side flaps 69 of the internal collar 42, on the other hand. On account thereof, the projecting folding flaps, specifically the outboard rear side flap 69 of the internal collar 42 and the collar side flaps 79, 80 in the completed pack, are mutually aligned in an approximately common vertical plane of the side walls. The number of material layers (of thin cardboard) on account of the internal collar 42, on the one hand, and of the external pack in the embodiment as a hinge-lid box having a collar 77, form the same number of material layers across substantially the entire height of the side walls. Also, the foil of the sealing block 11 may follow the contour of the internal collar 42, specifically while bearing on the external side of the rear side flap 69 of the internal collar 42 and in the upper region of the pack while bearing on the internal side of the collar side flaps 79, 80.

The folding flaps of the internal collar 42, specifically the internal side flaps 46 and the rear side flaps 69 are interconnected by adhesive bonding, presently by way of glue spots 83. Alternatively, stripe-shaped glue patterns or planar glue patterns are possible in this region. Folding flaps of the box side walls 19 and of the lid side walls 23 are likewise interconnected by adhesive bonding, presently by way of glue spots 83. The same applies to the external collar 77 of which the collar side flaps 79, 80 are preferably connected to the box side walls 19 by way of glue spots 83.

LIST OF REFERENCE SIGNS

10 Cigarette
11 Sealing block

12 Cigarette group
13 External pack
14 Box part
15 Lid
16 Linear articulation
17 Box front wall
18 Box rear wall
19 Box side wall
20 Base wall
21 Lid front wall
22 Lid rear wall
23 Lid side wall
24 End wall
25 Oblique edge
26 Block front wall
27 Block rear wall
28 Block side wall
29 Block end wall
30 Block base wall
31 Lateral seam
32 Base seam
33 Transverse seam
34 End piece
35 Perforation line
36 Closure tab
37 Removal opening
38 Closure label
39 Gripping tab
40 Closure edge
41 Appendage
42 Internal collar
43 Material web
44 Punching line
45 Internal front wall
46 Internal side flap
47 Longitudinal folding line
48 Internal base wall
49 Base tab
50 Top edge
51 Clearance
52 Punching line
53 Base flap
54 Connection flap
55 Folding line
56 Peripheral piece
57 Folding line
58 Folding line
59 Plug-in tongue
60 Plug-in slot
61 Appendage piece
62 Folding line
63 Corner clearance
64 End flap
65 Clearance
66 Peripheral web
67 Blank extension
68 Internal rear wall
69 Rear side flap
70 Base corner flap
71 Clearance
72 Punched feature
73 Material piece
74 Severing cut
75 Folding line
76 Attenuation line
77 External collar
78 Collar front wall
79 Collar side flap
80 Collar side flap
81 Clearance
82 Lower edge
83 Glue spot

What is claimed is:

1. A cigarette pack in which cigarettes (10) of a cigarette group (12) are surrounded by a blank of foil, comprising a sealing block (11) formed about the cigarrette group (12), wherein a supportive element of thin cardboard forms an internal collar (42) disposed in the interior of the sealing block (11), the internal collar (42) comprising an internal front wall (45), an internal base wall (48), and internal side flaps (46) and which at least partially surrounds the cigarette group (12), wherein the internal collar (42) in a lower region that is proximal to the internal base wall (48) is configured so as to have a closed cross section in such a manner that the cigarette group (12) in the lower region is on all sides surrounded by the internal collar (42).

2. A cigarette pack in which cigarettes (10) of a cigarette group (12) are surrounded by a blank of foil, comprising a sealing block (11) formed about the cigarette group (12), wherein a supportive element of thin cardboard forms an internal collar (42) disposed in the interior of the sealing block (11), the internal collar comprising an internal front wall (45), an internal base wall (48), and internal side flaps (46) and which at least partially surrounds the cigarette group (12), wherein the internal base wall (48) is formed from a base flap (53) which on account of a corresponding punching line (52) is configured as a part-face of the internal front wall (45) and by folding by successive folding steps, is folded into place as the internal base wall (48).

3. The pack as claimed in claim 2, wherein, on account of a correspondingly configured punching line (52), in the region of the internal front wall (45), a connection flap (54) is disposed below the base flap (53), and wherein, below the connection flap (54), a peripheral piece (56) as a base-side end region of the internal front wall (45) is formed, and wherein in an end position after the successive folding steps the connection flap (54) bears on the peripheral piece (56), and the base flap (53), attached to the connection flap (54), is folded into place as the internal base wall (48).

4. The pack as claimed in claim 3, wherein for delimiting the base flap (53) and the internal front wall (45) at least one plug-in tongue (59) and an allocated plug-in slot (60) are disposed in a region of folding lines (55, 57, 58) in such a manner that the base flap (53) and the internal front wall (45), in the end position, after the successive folding steps, are secured by a plug-in connection.

5. The pack as claimed in claim 2, wherein on account of an arrangement of a punching line (52), appendage pieces (61), which in the arrangement of the base flap (53) folded into place as the internal base wall (48), laterally adjoin the base flap (53) and extend in the region of the internal side walls and by folding in an upward direction bear on the internal side flaps (46) or find a receptacle in a corner clearance (63) formed by the internal side flaps (46), while connecting in a flush manner with the internal side flaps.

6. The pack as claimed in claim 3, wherein the internal front wall (45) in the region of a top edge (50) is configured such that a corresponding punched feature has a clearance (51), and opposite thereto in a region of the internal base wall (48), or as an extension of the peripheral piece (56), respectively, has a tongue-type protrusion which as a base tab (49) is folded into place of the internal base wall (48) while bearing on the base flap (53).

7. The pack as claimed in claim 5, wherein on the upper ends of the internal side flaps (46) and end flaps (64), of a size and contour corresponding to the corner clearances (63) on the opposite ends of the internal side flaps (46), are formed as a continuation, and wherein the end flaps (64) are folded over against an end face of the cigarette group (12), and against filters of the cigarettes (10).

* * * * *